US005549938A

United States Patent [19]

Nesbitt

[11] Patent Number: 5,549,938

[45] Date of Patent: Aug. 27, 1996

[54] REMOVABLE CAMOUFLAGE

[76] Inventor: Gregg G. Nesbitt, 3081 Dartmoor Ct., Shreveport, La. 71115

[21] Appl. No.: 335,061

[22] Filed: Oct. 13, 1994

[51] Int. Cl.[6] ..... F41H 3/00

[52] U.S. Cl. ..... 428/17; 296/191; 428/31; 428/99; 428/900; 428/919

[58] Field of Search ..... 428/919, 31, 900, 428/99, 17, 31; 296/191

[56] References Cited

U.S. PATENT DOCUMENTS

| | | | |
|---|---|---|---|
| 3,147,176 | 9/1964 | Haslam | 428/900 X |
| 4,187,332 | 2/1980 | Fouche, Jr. | 428/900 X |
| 4,310,978 | 1/1982 | Stern | 40/600 |
| 4,835,024 | 5/1989 | Hallay | 428/24 |
| 5,077,101 | 12/1991 | Conway et al. | 428/17 |
| 5,144,877 | 9/1992 | Parks | 89/36.01 |

*Primary Examiner*—Henry F. Epstein
*Attorney, Agent, or Firm*—John M. Harrison

[57] ABSTRACT

A removable camouflage primarily for hunting and military vehicles, which removable camouflage is characterized in a first preferred embodiment by a flexible, elastomeric magnetic panel having a selected camouflage pattern provided thereon. The camouflage panel is designed to magnetically attach to a steel surface such as the panels of a truck or other vehicle to facilitate quick and easy camouflaging of the vehicle without damaging or altering the paint on the vehicle. In another preferred embodiment the removable camouflage includes multiple, irregularly-shaped camouflage plates, also constructed of a magnetic material having a selected camouflage pattern thereon and capable of being attached to the steel surfaces of a vehicle to camouflage the vehicle. The camouflage pattern can be imprinted on the flexible magnetic material itself or on a vinyl overlay laminated on the flexible magnetic material.

8 Claims, 1 Drawing Sheet

REMOVABLE CAMOUFLAGE

BACKGROUND OF THE INVENTION

1. Field of the Invention

This invention relates to the camouflaging of hunting and military vehicles and more particularly, to removable camouflage which can be quickly and easily attached to and removed from a vehicle having steel body panels without damaging or altering the vehicle paint. In a first preferred embodiment the removable camouflage is characterized by a flexible, elastomeric magnetic panel or sheet of selected size and shape and having a selected camouflage pattern provided thereon for fitting directly on and removably magnetically adhering to the steel surfaces of the vehicle and camouflaging the vehicle. In a second preferred embodiment the removable camouflage includes multiple camouflage plates of selected size, shape and camouflage pattern for removable magnetic attachment to the steel surfaces of the vehicle and camouflaging the vehicle. Both the camouflage panel and the camouflage plates are typically constructed of a flexible elastomeric matrix having magnetic filings or other magnetic particles embedded therein or material provided with an induced magnetic charge or a static charge, for magnetic or static attachment to the steel vehicle surfaces. Furthermore, the selected camouflage pattern can be applied directly to the magnetic elastomeric surface by such techniques as silk screening, painting and other techniques well known to those skilled in the art. Alternatively, a vinyl sheet can be applied to the magnetic elastomeric material to define a laminated sheet and facilitate printing, silk screening or other application of the desired camouflage pattern. The camouflage pattern can be applied to the magnetic elastomeric itself or to the vinyl overlay in a continuous process by paint or silk screen rollers or a preprinted vinyl sheet can be laminated on the underlying magnetic vinyl or plastic base in a continuous process by a pressure roller or rollers, further according to the knowledge of those skilled in the art. In the case of the camouflage plates, a suitable stamping or cutting mechanism can be utilized to die cut the various plates from a continuous roll of magnetic elastomer, with or without the vinyl overlay, also according to techniques known to those skilled in the art.

2. Description of the Prior Art

Various types of camouflaging techniques for camouflaging hunting and military vehicles are well known in the art. Typical of these techniques is painting the vehicle with an olive drab or combinations of such colors as olive drab, orange, brown, green, black and tan in any variation necessary to create the desired camouflage color combinations that will blend with the terrain where the hunting or military operation is taking place. This technique typically necessitates application of a paint directly to the vehicle surface, thereby overlaying the underlying primer or paint covering the vehicle. While such alteration of the surface characteristics of a military vehicle may be perfectly satisfactorily because the military vehicle is used for no other purpose than for military operations, the alternative is frequently unsatisfactory for the occasional hunter who also uses his pickup truck or other vehicle for activities other than hunting. Accordingly, the painting of a pickup truck or alternative vehicle for hunting purposes frequently means repainting the vehicle after the hunting season for ordinary street use until the next hunting season.

Various types of magnetic devices have been used on vehicles for various purposes. For example, U.S. Pat. No. 3,147,176, dated Sep. 1, 1964, to J. E. Haslam, details a "Magnetic Car Door Protector" which includes a magnetic strip fitted with shock-resistant members for attachment to the door of an automobile to protect the door against damage from the opening doors of adjacent cars. U.S. Pat. No. 4,835,024, dated May 30, 1989, to Gary H. Hallay, details a "Decorative Article For A Magnetizable Surface". The decorative article is designed for releasable attachment to a magnetizable surface such as steel and includes a base of magnetized sheet material and a projection member attached to the base, which serves to hold an ornament on the base in an assembled state. The base is constructed of a resilient magnetic sheet and the projection member includes a connection member for attaching the projection member to the base in an integral, upstanding projection. A sleeve having a head is received on the upstanding projection and interposed in the head of the sleeve and the base is an ornament held in an assembled state by the interaction of the base, the head of the sleeve and the upstanding projection. A "Three-Color Infrared Camouflage System" is detailed in U.S. Pat. No. 5,077,101, dated Dec. 31, 1991, to Conway et al. The system includes layers of camouflage material having low, intermediate and high thermal emissivities in the infrared spectrum range and appearing black, green and brown in the visible spectrum range. The camouflage system may be used in the construction of decoys, as well as for camouflaging vehicles. U.S. Pat. No. 5,144,877, dated Sep. 8, 1992, to Jeffrey S. Parks, details a "Photoreactive Camouflage". The camouflage is designed for application to the exterior of a military vehicle and includes a set of photoreactive lenses placed on the vehicle, the lenses having an irregular topography and a thin, antireflection film on the faces of the lens. The system reduces or eliminates contrast between illuminated and shadowed panels of the vehicle, so that the vehicle more thoroughly blends into the background against which the vehicle is viewed.

It is an object of this invention to provide removable magnetic camouflage for vehicles having steel body panels, which camouflage is characterized by a flexible magnetic base material having a suitable camouflage pattern provided thereon.

Another object of the invention is to provide a removable camouflage which includes at least one flexible camouflage panel or sheet having magnetic properties and imprinted with a selected camouflage pattern, for removable attachment to the steel body panels of a hunting or military vehicle.

Yet another object of the invention is to provide easily portionable and removable magnetic camouflage which includes multiple camouflage plates of selected size, shape and thickness and formed from a flexible, elastomeric magnetic material, for removable attachment to a vehicle having steel body panels and camouflaging the vehicle.

Still another object of this invention is to provide a removable camouflage that includes one or more shaped panel sheet or individual, irregularly-shaped camouflage plates of selected size and constructed of a flexible, elastomeric magnetic material having a camouflage pattern imprinted either directly on the magnetic material or on a vinyl film or sheet laminated to the magnetic material, to camouflage the vehicle.

SUMMARY OF THE INVENTION

These and other objects of the invention are provided in new and improved removable camouflage for vehicles having steel body panels or parts, including hunting vehicles and military vehicles, which removable camouflage is characterized in a first preferred embodiment by flexible, elastomeric magnetic panels or sheets having a suitable camouflage material imprinted or otherwise applied thereon and fitted on the vehicle for camouflaging the vehicle. In a second preferred embodiment the removable camouflage is characterized by multiple, irregularly-shaped camouflage plates of selected size and constructed of a flexible, elastomeric magnetic material and having a suitable camouflage pattern in selected colors provided thereon for attachment to the vehicle. In another preferred embodiment of the invention a vinyl or alternative print-sensitive film can be laminated to the flexible, elastomeric magnetic material to define a laminate, for printing, silk screening or otherwise applying a suitable camouflage pattern to the laminate.

BRIEF DESCRIPTION OF THE DRAWINGS

The invention will be better understood by reference to the accompanying drawing, wherein.

DESCRIPTION OF THE PREFERRED EMBODIMENTS

Figure 1:
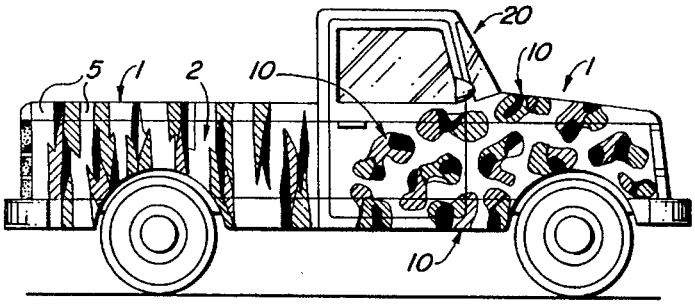
FIG. 1 is a side view of a pickup truck fitted with a camouflage panel or sheet and multiple, irregular camouflage plates each constructed of a flexible, elastomeric magnetic material according to the invention.
Figure 8:
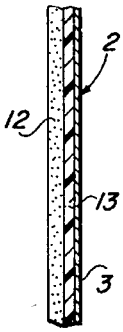
FIG. 8 is a sectional view taken along 8—8 of the flexible camouflage panel or sheet illustrated in FIG. 3, with the mottled pattern applied to a vinyl overlay laminated to the elastomeric magnetic material.
Figure 7:
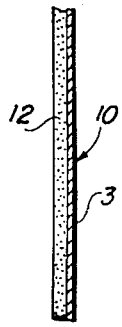
FIG. 7 is a sectional view taken along line 7—7 of the camouflage plate illustrated in FIG. 6.
Figure 9:
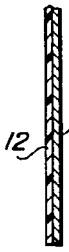
FIG. 9 is a sectional view of a typical flexible, elastomeric magnetic base material with a mottled pattern applied directly to the elastomeric magnetic material.
Figure 3:
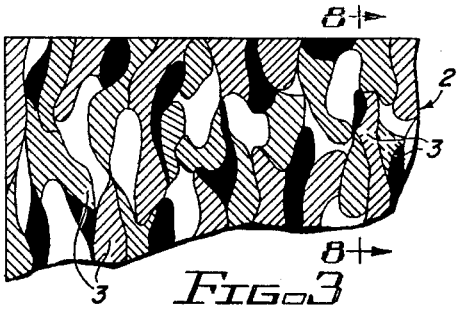
FIG. 3 is a front view, partially in section, of a mottled pattern flexible camouflage panel or sheet embodiment of the removable camouflage illustrated in FIG. 1.
Figure 5:
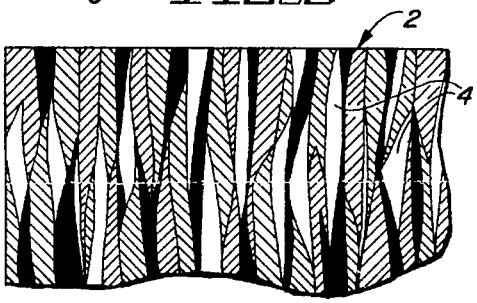
FIG. 5 is a front view, partially in section, of a striped pattern flexible camouflage panel or sheet embodiment of the removable camouflage illustrated in FIG. 1.
Figure 11:
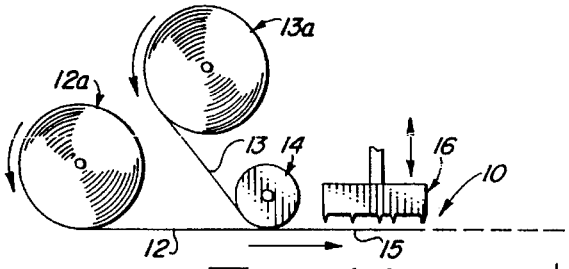
FIG. 11 is a side view of a typical assembly technique for constructing a laminated camouflage panel or sheet and laminated camouflage plates.

Referring initially to FIG. 1 of the drawing, the removable camouflage of this invention is generally illustrated by reference numeral 1, fitted on a pickup truck 20. In a first preferred embodiment of the invention the removable camouflage 1 is characterized by a flexible camouflage panel 2, typically having a mottled pattern 3 as illustrated in FIG. 3, or a striped pattern 4 as illustrated in FIG. 5. The mottled panel 3 is also typically diversified with spots or blotches of different colors or shades to create a pattern which resembles the surroundings in which the pickup truck 20 will be travelling or parked. Similarly, the striped pattern 4 simulates the bark of trees or tall grass in an effort to provide a similarity to the surrounding topography for camouflage purposes. In a preferred embodiment of the invention the camouflage panel 2 is characterized by a flexible, elastomeric magnetic base 12, such as rubber or vinyl and either contains iron filings or other magnetic particles embedded in the rubber or vinyl matrix. Alternatively, the flexible, elastomeric magnetic base 12 is characterized by a material which is capable of receiving a static charge to facilitate magnetic attachment to a steel surface such as the rear bed panels of the pickup truck 20, as illustrated in FIG. 1. A vinyl sheet 13 may be laminated to the flexible magnetic base 12 to provide a smooth, calendered surface for silk screening, painting or otherwise applying a camouflage pattern such as the mottled pattern 3 or striped pattern 4, as illustrated in FIGS. 3, 5 and 8. Alternatively, the mottled pattern 3 or striped pattern 4 can be applied directly to the surface of the flexible magnetic base 12, as illustrated in FIG. 9, by techniques that are well known to those skilled in the art.

Figure 2:
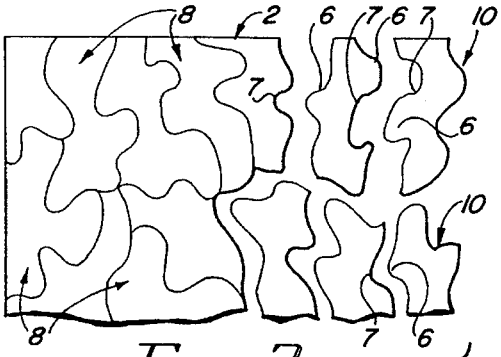
FIG. 2 is a front, partially exploded view of the camouflage plates embodiment illustrated in FIG. 1.
Figure 6:
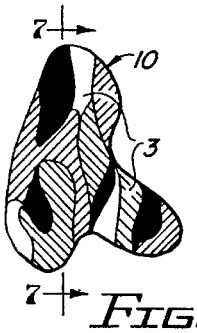
FIG. 6 is an enlarged view of a single camouflage plate illustrated in FIG. 1, more particularly illustrating a mottled camouflage pattern.
Figure 4:
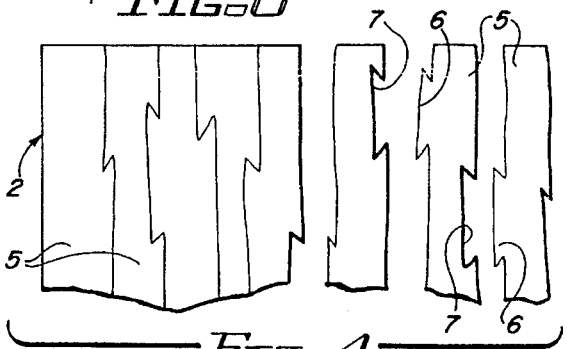
FIG. 4 is a front, partially exploded view of a simulated tree bark camouflage pattern for the camouflage plates illustrated in FIG. 1.

Referring now to FIGS. 1, 2, 4, 6 and 7 of the drawings, in another preferred embodiment of the invention multiple flexible, irregularly-shaped camouflage plates 10 characterize the removable camouflage 1 and the camouflage plates 10 are typically constructed of a flexible, elastomeric magnetic base material such as the flexible, elastomeric magnetic base 12 in the camouflage panel 2 and may include the laminated vinyl sheet 13, as illustrated with respect to the camouflage panel 2, illustrated in FIG. 8. The camouflage plates 10 are typically constructed in random, irregular shapes as illustrated in FIGS. 2, 4 and 6. For example, as illustrated in FIGS. 2, 4 and 6, the respective camouflage plates 10 may resemble the pieces of a jigsaw puzzle, although they are preferably much larger in size and may include tabs 6 and cooperating slots 7 for interlocking purposes, with camouflage patterns such as the simulated tree bark pattern 5, illustrated in FIG. 4 and mottled pattern 6, illustrated in FIG. 6. As in the case of the camouflage pattern 2, the camouflage plates 10 may also be characterized by a striped pattern 4, as well as a single color pattern 8, as illustrated in FIG. 2. Accordingly, it will be appreciated from a consideration of the drawing that the removable camouflage 1, in either the camouflage panel 2 configuration or the camouflage plates 10 configuration, may include various camouflage patterns known to those skilled in the art, including, but not limited to, the mottled pattern 3, striped pattern 4, simulated tree bark pattern 5 and single color pattern 8. In addition, the camouflage plates 10 may be designed to interlock in a selected pattern to form a solid camouflage panel 2 as illustrated in FIGS. 2 and 4 or the respective camouflage plates 10 may be spaced from each other and applied directly and randomly to the steel surface of the pickup truck 20, as illustrated in FIG. 1.

Figure 10:
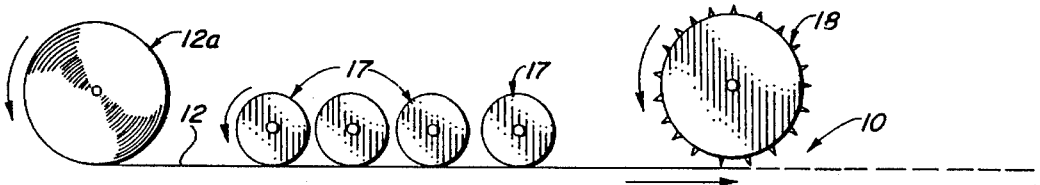
FIG. 10 is a side view of a typical assembly technique for constructing the camouflage panel or sheet illustrated in FIG. 9 and the camouflage plates illustrated in FIGS. 1, 2, 4, 6 and 7.

Referring now to FIG. 10 of the drawings, under circumstances where it is desired to paint, silk screen, imprint or otherwise apply a pattern such as the mottled pattern 3, striped pattern 4, simulated tree bark pattern 5 or single color pattern 8 directly on a flexible, elastomeric magnetic base 12, a magnetic base roll **12*a* of flexible, elastomeric magnetic base material 12 may be positioned as illustrated. The sheet of magnetic, elastomeric base material 12 is unrolled from the magnetic base roll 12*a* by means of applicable machinery and multiple printing rollers 17 are operated to silk screen, print or otherwise apply the desired camouflage pattern, such as the mottled pattern 3, striped pattern 4, simulated tree bark pattern 5 or single color pattern 8 directly on the flexible, elastomeric magnetic base 12, as illustrated. The resulting camouflage panel 2 with the desired pattern printed thereon may then be cut and shaped to fit the various body panels of the pickup truck 20, as in the case of the truck bed body panels in FIG. 1. Alternatively, a cutting device such as a rotary die 18 may be provided to cut the flexible, elastomeric magnetic base 12 sheet into various camouflage plates 10 of desired size and shape and facilitate removable magnetic application of the camouflage plates 10 to the door, fender and hood panels of the pickup truck 20, as illustrated in FIG. 1**.

In another preferred embodiment of the invention, under circumstances where the vinyl sheet 13 is to be applied to the flexible, elastomeric magnetic base 12 to facilitate easier application of such camouflage designs as the mottled pattern 3, striped pattern 4, simulated tree bark pattern 5 and the single color pattern 8, a mechanism which includes a magnetic base roll 12*a* and a vinyl sheet roll 13*a* may be utilized. The sheet of flexible, elastomeric magnetic base material 12 is unrolled from the magnetic base roll 12*a*, while a vinyl sheet 13 is simultaneously unrolled from the vinyl sheet roll 13*a* and the vinyl sheet 13 is continuously laminated and glued or otherwise attached to the flexible, elastomeric magnetic base 12 by means of a laminating roll 14, to create a laminated sheet 15. The laminated sheet 15 is cut and shaped as a camouflaged panel 2 having a vinyl sheet 13 laminated thereon. The camouflage panel 2 is then extended beneath printing roller 17 as illustrated in FIG. 10 to silk screen, paint or otherwise apply such camouflage designs as the mottled pattern 3, striped pattern 4, simulate tree bark panel 5 and the single color pattern 8 to the vinyl sheet 13 in the matter illustrated in FIG. 10. The laminated camouflage panel 2 so created can then be shaped and applied directly to the bed panels of a pickup truck 20 as illustrated in FIG. 1 or fed through either a stamping die 16 or a rotary die 18 to cut the laminated camouflage panel 2 into laminated camouflage plates 10, as heretofore described, for removable magnetic application to the pickup truck, as further illustrated in FIG. 1.

It will be appreciated by those skilled in the art that the flexible, elastomeric magnetic base 12 element of the camouflage panel 2 and the camouflage plates 10, whether laminated with the vinyl sheet 13 or not, can be constructed of any desired thickness, usually ranging from about 20 mils to about 60 mils, according to the desires of the user. In a most preferred embodiment of the invention the material chosen for the flexible, elastomeric magnetic base 12 is fabricated in continuous rolls, typically about 24 inches wide and includes a layer of powdered magnetic material such as iron filings bound and dispersed in a plastic or rubber binder and coated onto an elastomeric base which provides support and mechanical strength in the same way that magnetic tape is processed. The elastomeric base may be made of a polyester or rubber material and the magnetic coating may be very thin and contains many millions of particles of magnetic powder. Each particle behaves like a small magnet and the particles are usually so small that they can only be seen with an electron microscope. The magnetic material may be magnetic iron filings or an oxide of iron known as the gama oxide which gives it magnetic base a brown or black color, since finally divided carbon black may be added to conduct away any electrostatic charge that might accumulate on the material. Other materials used in placed of iron oxide include cobalt, iron oxides and chromium dioxide. Still other materials well known to those skilled in the art, including those which retain a static charge, may be used in the construction of the flexible, elastomeric magnetic base 12 to impart a magnetic or static attraction faculty to the flexible, elastomeric magnetic base 12 and enable magnetic or static attachment to steel panels, as well as windows, of the pickup truck 20 and other vehicles.

It will be further appreciated by those skilled in the art that substantially any desired camouflage pattern may be utilized in both the camouflage panel 2 and the camouflage plates 10 embodiments of the invention, including, but not limited to, the mottled pattern 3, striped pattern 4, simulated tree bark pattern 5 and the single color pattern 8. Furthermore, these and other selected patterns can be designed to simulate any desired terrain, both for the purposes of hunting and military application and both the camouflage panels 2 and the camouflage plates 10 can be attached to such vehicles as pickup trucks, all terrain vehicles and various other types of hunting vehicles, as well as military vehicles such as tanks, trucks, jeeps and the like, in non-exclusive particular.

A primary feature of the removable camouflage of this invention, in both the camouflage panel 2 and camouflage plate 10, either laminated or unlaminated, embodiments, is the facility for quickly and easily applying both the camouflage panel 2 and the camouflage plates 10 to the steel body panels of vehicles in order to camouflage the vehicles for a desired period of time. Washing and cleaning the camouflaged vehicles may be effected without removing the camouflage panel or panels 2 or the camouflage plates 10 and the camouflage panel 2 or camouflage plates 10 may be easily removed without damaging the underlying paint on the vehicle being camouflaged, such as the pickup truck 20. The removable camouflage can also be attached to the steel body panels of boats, in addition to vehicles, as desired. Furthermore, the magnetic attraction of the flexible, elastomeric magnetic base 12 securely maintains both the camouflage panels 2 and the camouflage plates 10 in place as originally positioned and facilitates a quick and easy camouflaging of substantially any vehicle having steel body panels, without the necessity of painting the camouflage pattern on the vehicles.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A removable camouflage panel for magnetic attachment to steel body panels of a vehicle, comprising sheets of flexible, elastomeric magnetic material shaped to substantially fit the body panels of the vehicle and a selected camouflage pattern provided on said sheets of flexible, elastomeric magnetic material for camouflaging the vehicle.

2. The removable camouflage panel of claim 1 comprising a vinyl film laminated on each of said sheets of flexible, elastomeric magnetic material for receiving said camouflage pattern.

3. The removable camouflage panel of claim 1 wherein said camouflage pattern is selected from the group consisting of a mottled pattern, a striped pattern, a simulated tree bark pattern and a single color pattern.

4. The removable camouflage panel of claim 3 comprising a vinyl film laminated on each of said sheets of flexible, elastomeric magnetic material for receiving said camouflage pattern.

5. A removable camouflage for attachment to steel body panels on a vehicle, comprising a plurality of irregularly shaped plates of flexible, elastomeric magnetic material for magnetic attachment in selected patterns to the body panels of the vehicle and a selected camouflage pattern provided on said plates of flexible, elastomeric magnetic material for camouflaging the vehicle.

6. The removable camouflage of claim 5 comprising a vinyl film laminated on each of said plates of flexible, elastomeric magnetic material for receiving said selected camouflage pattern.

7. The removable camouflage of claim 5 wherein said camouflage pattern is selected from the group consisting of a mottled pattern, a striped pattern, a simulated tree bark pattern and a single color pattern.

8. The removable camouflage of claim 7 comprising a vinyl film laminated on each of said plates of flexible, elastomeric magnetic material for receiving said camouflage pattern.

* * * * *